US008535069B2

(12) United States Patent
Zhang

(10) Patent No.: US 8,535,069 B2
(45) Date of Patent: Sep. 17, 2013

(54) SHIELDED ELECTRICAL CONNECTOR WITH GROUND PINS EMBEDED IN CONTACT WAFERS

(75) Inventor: George Huanyi Zhang, Irvine, CA (US)

(73) Assignee: Hon Hai Precision Industry Co., Ltd., New Taipei (TW)

( * ) Notice: Subject to any disclaimer, the term of this patent is extended or adjusted under 35 U.S.C. 154(b) by 80 days.

(21) Appl. No.: 13/343,661

(22) Filed: Jan. 4, 2012

(65) Prior Publication Data

US 2013/0171885 A1 Jul. 4, 2013

(51) Int. Cl.
*H01R 4/66* (2006.01)

(52) U.S. Cl.
USPC ..... 439/108; 439/607.05

(58) Field of Classification Search
USPC ..... 439/108, 607.05–607.08
See application file for complete search history.

(56) References Cited

U.S. PATENT DOCUMENTS

| | | | | |
|---|---|---|---|---|
| 6,129,555 | A | 10/2000 | Daikuhara et al. | |
| 6,712,646 | B2 | 3/2004 | Shindo | |
| 7,163,421 | B1 | 1/2007 | Cohen et al. | |
| 7,249,966 | B2 | 7/2007 | Long | |
| 8,016,616 | B2 * | 9/2011 | Glover et al. | 439/607.05 |

* cited by examiner

*Primary Examiner* — Khiem Nguyen
(74) *Attorney, Agent, or Firm* — Wei Te Chung; Ming Chieh Chang

(57) ABSTRACT

An electrical connector assembly includes a receptacle and a plug. The receptacle includes a housing defining two vertical stacked mating slots and a plurality of wafers loaded in the housing. Each wafer includes an upper pair and a lower pair of contacting portions, the upper pairs and the lower pairs of the wafers expose to the slots respectively. Each of the wafers further defines a ground contact with a contacting portion between the upper pair and lower pair of the contacting portions. The plurality of wafers includes pairs of differential signal wafers and ground wafers which are arranged in an alternating sequence in the connecting housing. The plug includes two card edges and a ground plate with a row of contacting pin between the card edges. The contacting pins of the ground plate touch with pairs of ground contacts formed with two adjacent ground contacts in two adjacent wafers.

14 Claims, 10 Drawing Sheets

SHIELDED ELECTRICAL CONNECTOR WITH GROUND PINS EMBEDED IN CONTACT WAFERS

CROSS-REFERENCE TO RELATED APPLICATION

This application is related to a prior patent application which is filed on Aug. 23, 2010, application Ser. No. 12/861,131 and entitled "SHIELDED ELECTRICAL CONNECTOR". The inventor of the present patent application is one of three inventors of the prior patent application. Those two applications will assign to a same assigner, Hon Hai Precision IND CO., LTD.

BACKGROUND OF THE INVENTION

1. Field of the Invention

The present invention relates generally to a shielding electrical connector, and more particularly to an electrical connector with a row of ground contacts or shielding contacts embedded in terminal wafers.

2. Description of Related Art

A shielded electrical connector is provided having several rows of contacts inside the housing and outer metallic shell for the purpose of shielding. Such shielded electrical connectors are widely used in computers, work stations and other types of electronic office equipment for the connection of signal-carrying lines. In such shielded electrical connectors, the metal shell prevents electromagnetic noise from penetrating into the connector, but it does not eliminate the problem related to cross-talk between contact pins.

Hence, it is desired to provide an electrical connector to overcome the problems mentioned above.

BRIEF SUMMARY OF THE INVENTION

An electrical connector assembly comprises a receptacle connector and a plug connector intended to mate with the receptacle connector. The receptacle connector comprises a connector housing defining two parallel mating slots vertically spaced from each other and a plurality of terminal wafers juxtaposedly loaded in the connector housing. Each terminal wafer comprises an upper pair of contacting portions and a lower pair of contacting portions, the upper pairs of contacting portions of the plurality of terminal wafers exposing and the lower pairs of contacting portions of the plurality of terminal wafers exposing to the two mating slots respectively. Each of said terminal wafers further defines a ground contact with a contacting portion disposed between the upper pair and lower pair of the contacting portions. The plurality of terminal wafers comprises pairs of differential signal wafers and ground wafers which are arranged in an alternating sequence in the connecting housing. The plug connector comprises two card edges intended to be inserted in the mating slots respectively and a ground plate with a row of contacting pin vertically spaced between said two card edges. The contacting pins of the ground plate touch with pairs of ground contacts formed with two adjacent ground contacts in two adjacent terminal wafers.

Other objects, advantages and novel features of the invention will become more apparent from the following detailed description of the present embodiment when taken in conjunction with the accompanying drawings.

DETAILED DESCRIPTION OF THE PREFERRED EMBODIMENT

Figure 1:
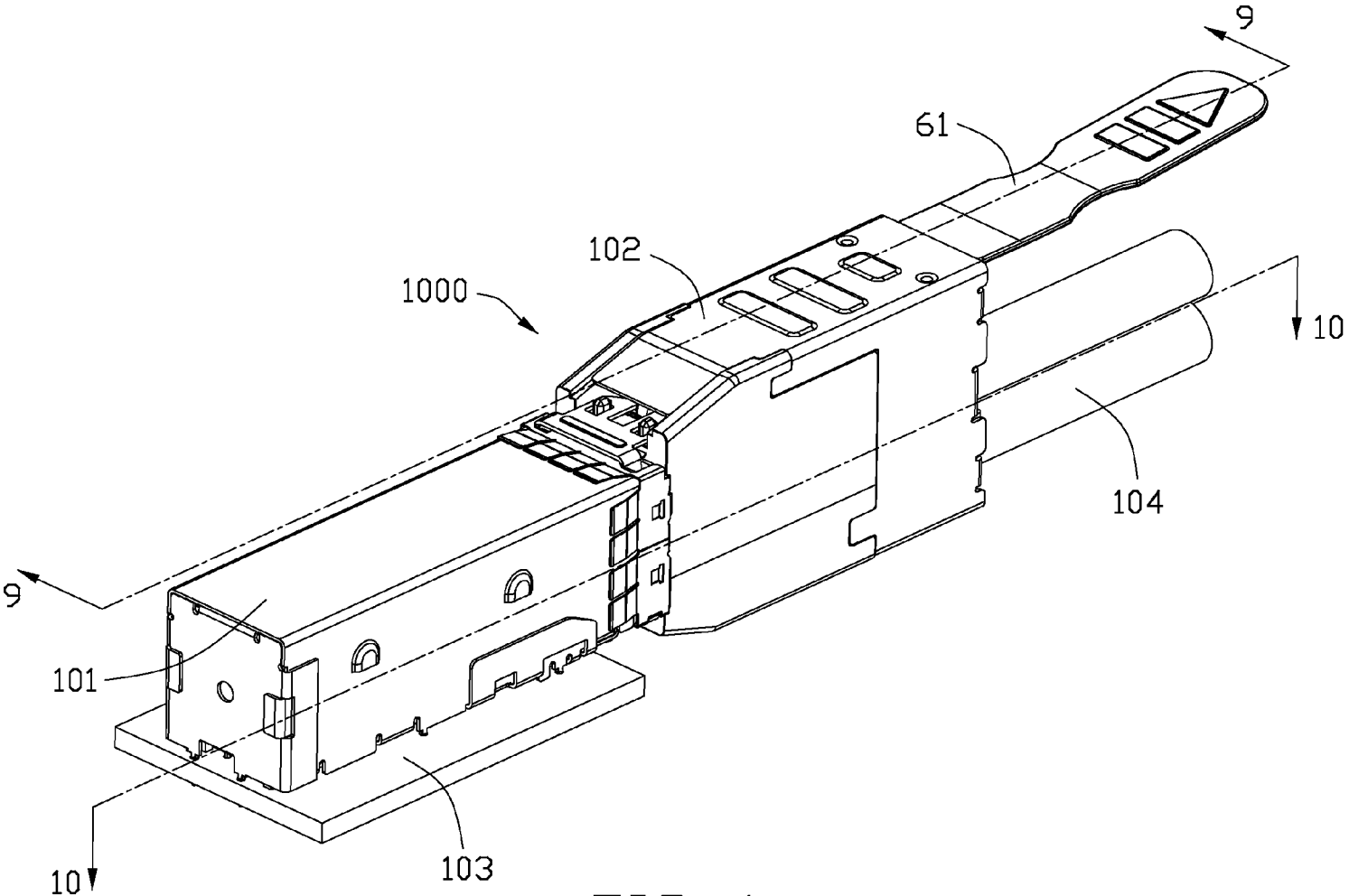
FIG. 1 is a perspective view of an electrical connector assembly according to the present invention, which includes a receptacle connector and a plug connector.
Figure 2:
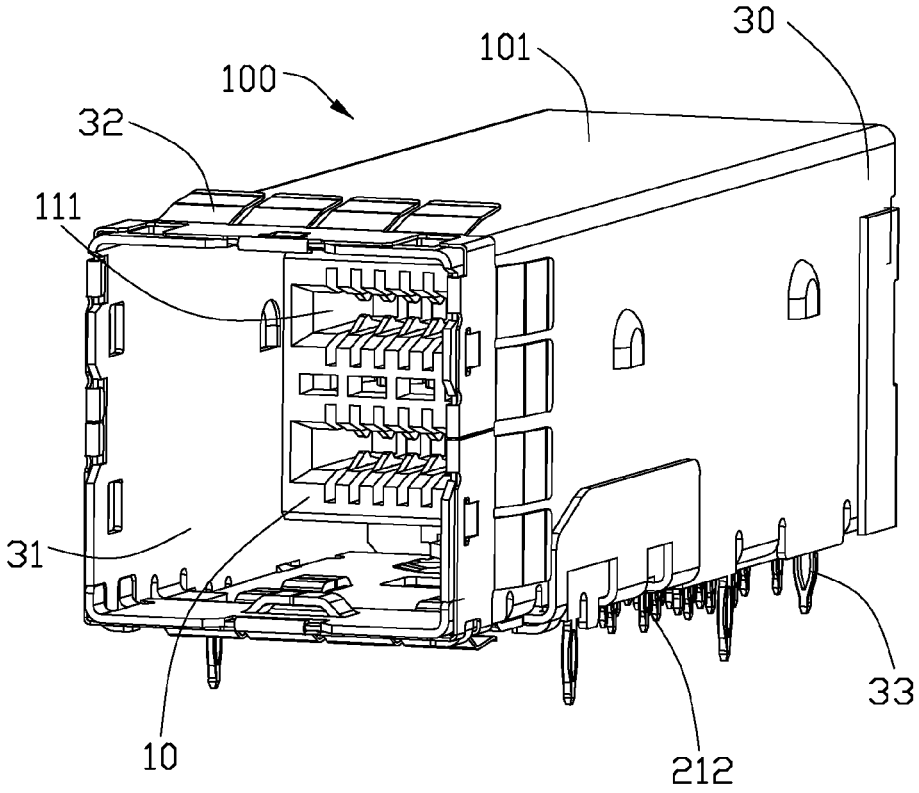
FIG. 2 is a perspective view of the receptacle connector shown in FIG. 1.
Figure 3:
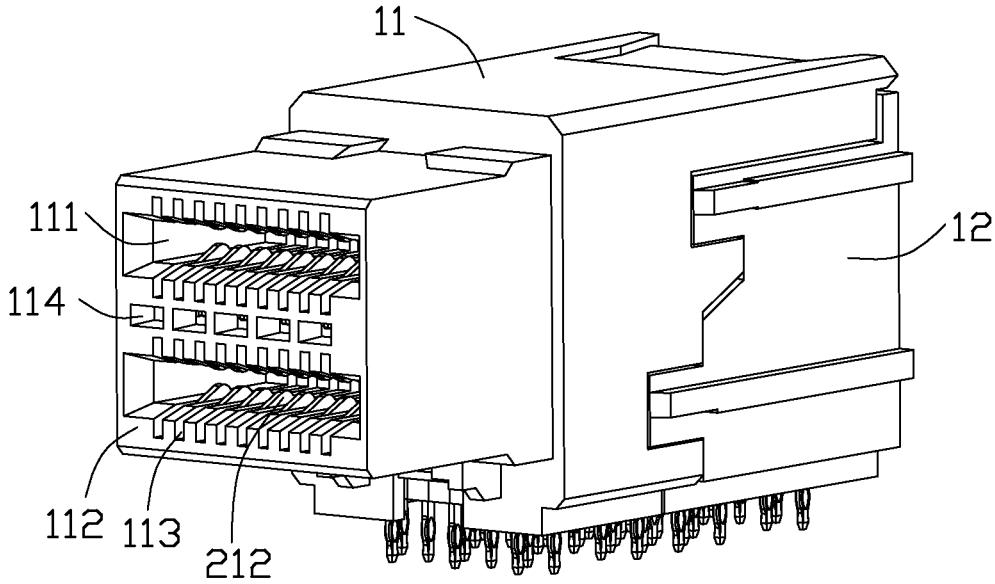
FIG. 3 is a perspective view of the connector housing of the receptacle connector, the metal cage is removed.

Reference will be made to the drawing figures to describe the present invention in detail, wherein depicted elements are not necessarily shown to scale and wherein like of similar elements are designated by same or similar reference numeral through the several views and same or similar terminology.

Referring to FIG. 1, an electrical connector assembly 1000 according to a preferred embodiment of the present invention is disclosed, which is compliable to a Mini Multilane Shielded Integrated HD Connector for use in high speed serial, interconnect applications at speeds up through 12 Gigabits/second, written in SFF 8644 Specification by Molex Incorporation, which is also named as Mini SAS HD external. The assembly 1000 includes a receptacle connector 101 and a plug connector 102 mated with each. The receptacle connector 101 is mounted on and electrically connected to a printed circuit board (PCB) 103 which is assembled in a system end, and the plug connector 102 is electrically coupled to cables 104. The plug connector 102 disconnects from the receptacle connector 101 by a pull tab 61.

Referring to FIGS. 2-5, the receptacle connector 101 has a connector housing 10 and a metal cage 30 surrounding the connector housing 10. The cage 30 is in a form of rectangle and has a front mating opening 31 through which the plug connector 102 is inserted in mating slot 111 defined in the connector housing 10. A metal gasket 32 is formed at an outer periphery of the mating opening 31. The cage 30 has an opening (not labeled) in a rear bottom wall thereof so the connector housing 10 is located in the mating opening 31, thereby being mounted on the PCB 103 with press-fit tail portions 212 of terminals which will be described hereinafter. The cage 30 extends a plurality of press-fit solder legs 33 which are intended to be inserted in the PCB 104.

Figure 6:
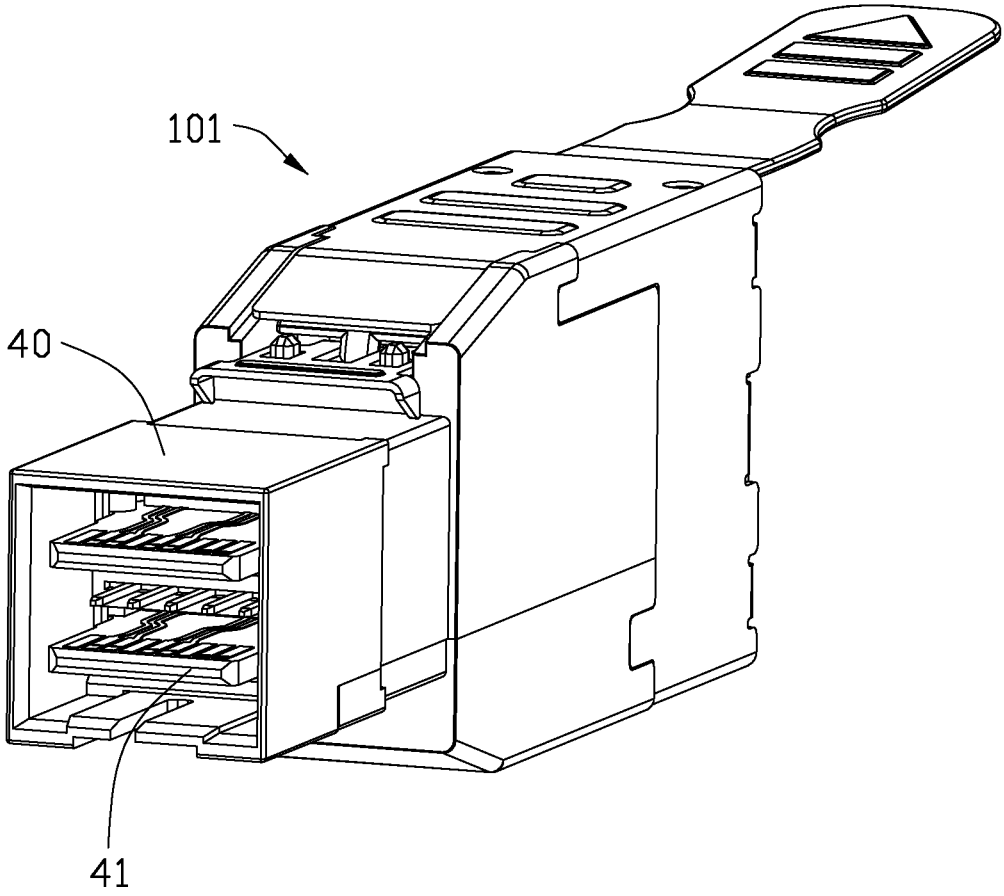
FIG. 6 is a perspective view of the plug connector shown in FIG. 1.

The connector housing 10 is formed in two insulating pieces, a front/first section 11 and a rear/second second section 12. The first section 11 includes openings shown in the form of said mating slots 111 running through a front face 112 thereof. The two mating slots 111 into which edge cards 41 of the plug connector 102 as shown in FIG. 6 may be inserted, are disposed parallel to each other in a vertical direction or stacked vertically. A plurality of terminal wafers 20 e.g., a set of wafers 20 that are arranged in side-by-side order are assembled in the connector housing 10. Each wafer 20 supports a plurality of conductive terminals 21 that each includes a contacting portion 211 in a contacting beam form, a tail portion 212 and a body portion 213 interconnecting the contacting portion and tail portions 211, 212 together. The body portions 213 are embedded in the insulating supports 23, the contacting portions and the tail portion extend beyond a front edge and a bottom edge of the terminal wafers respectively. The plurality of wafers 20 is inserted into the first section 11 from a back of the first section 11 of the connector housing 10 and the second section 12 are covered at the back of the first section to protect the wafers 20. The contacting portions 211 of the terminals of the wafers are located in passageways 113 defined on two opposite inner sides of the mating slots 111 respectively. The tail portions 212 expose to a mounting edge of the receptacle connector 101. The insulating support 23 defines a groove 231 running through the body portions 213 adjacent to the tail portions to expose somewhat of the body portions.

Figure 7:
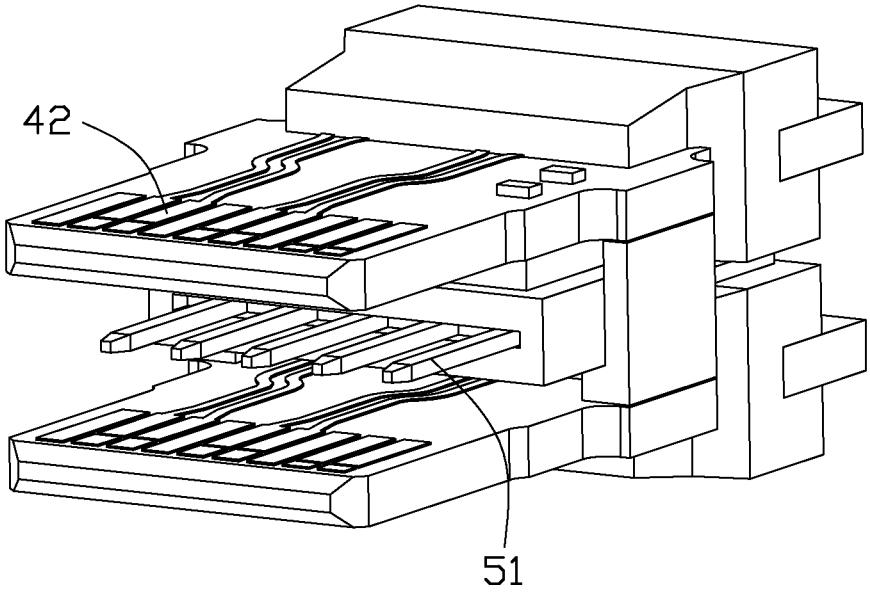
FIG. 7 is a perspective view of a mating end of the plug connector.
Figure 8:
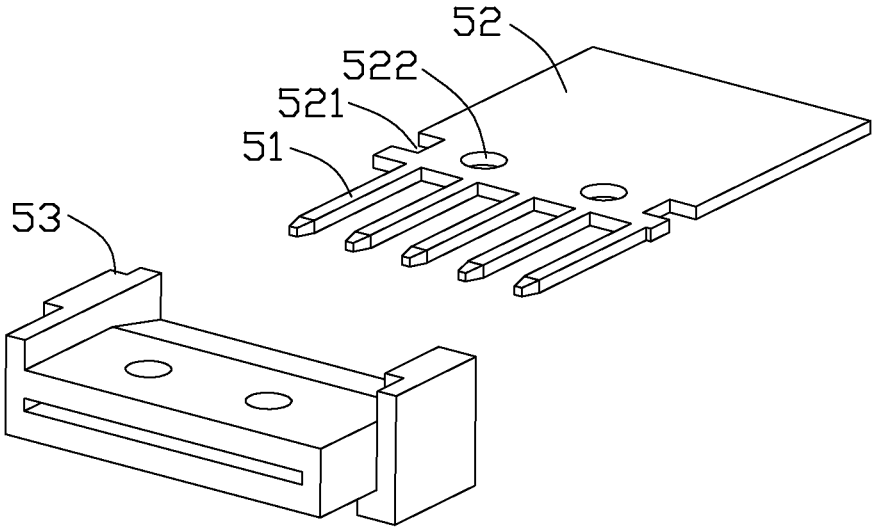
FIG. 8 is an exploded perspective view of ground plate.
Figure 9:
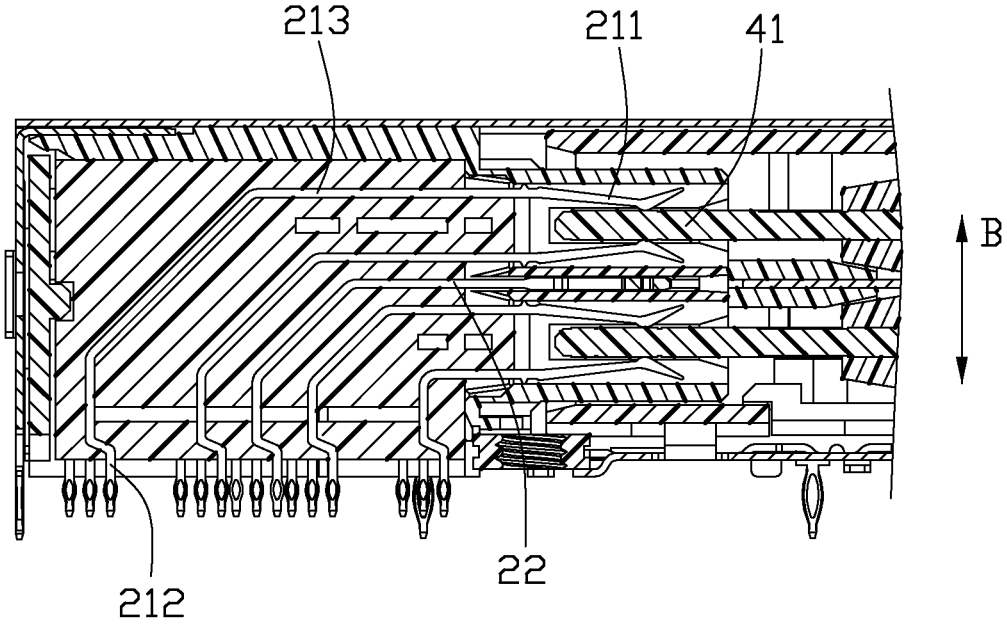
FIG. 9 is a cross-section view of the electrical connector assembly taken along lines 9-9 shown in FIG. 1.

Referring to FIGS. 6 through 8, the plug connector 101 includes a mating end 40 with two parallel card edges 41 which are intended to be inserted in the mating slots 111 of the receptacle connector 101. The two card edges 41 space from each other in the vertical direction and are embedded with conductive pads 42 on the two surface of the front edge of the card edges 41, thereby slide with the contacting portions 211 of the receptacle connector when the plug connector 102 is inserted in the receptacle connector 101. The cables 104 are connecting with conductive pads (not shown) on the back edge of the mating end 40 of the plug connector. When the mating end 40 of the plug connector 101 is inserted in the mating slots 111 of the receptacle connector 102 as best shown in FIG. 9, the contacting portions 211 in the opposite inner sidewall of the mating slots 111 are engaged with the conductive pads of the card edges 41 by clamping. Moreover, a row of ground terminals 22 of the receptacle connector 101 are connected with corresponding contacting pins disposed between said two card edges 41 to decrease cross talk between the terminals, which will be introduced hereinafter.

Figure 4:
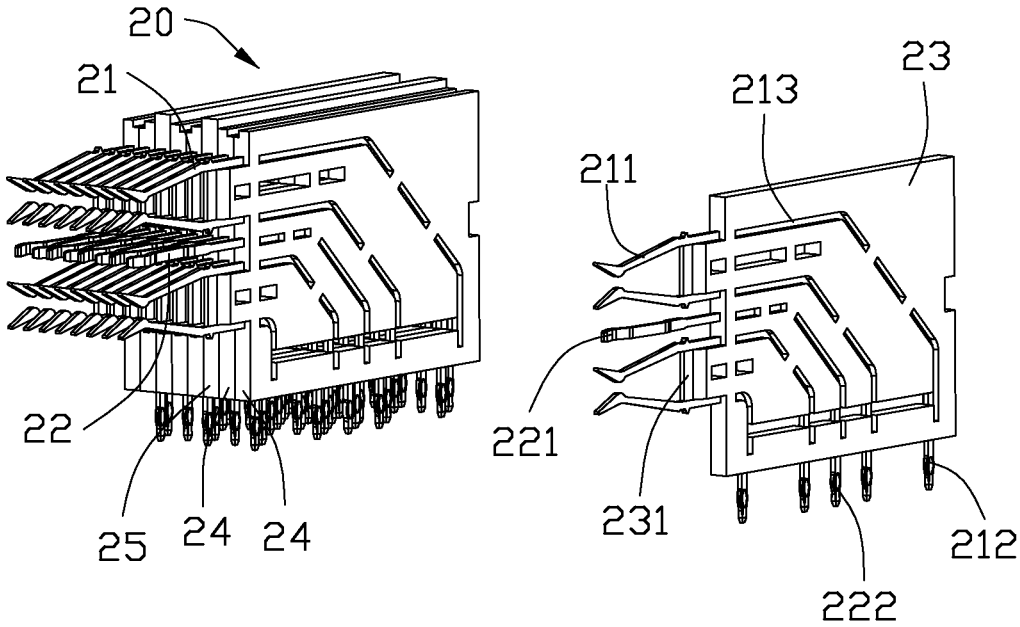
FIG. 4 is a perspective view of a set of terminal wafers used in the connector housing.
Figure 5:
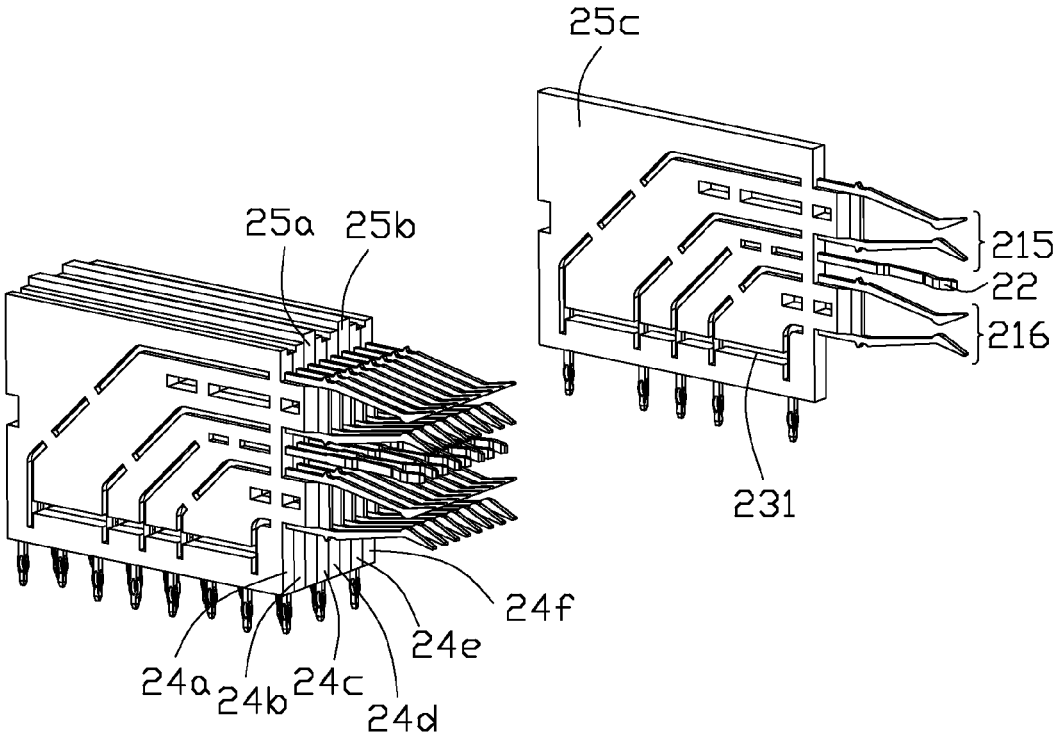
FIG. 5 is a same view to FIG. 4, but illustrating from another view.

Referring to FIGS. 4 and 5, three pairs of first wafers identified by reference numeral 24 is installed between second wafers identified by reference numeral 25. The pair of first wafers 24 is two single signal wafers 24 disposed alongside so that said two adjacent signal wafers 24*a*, 24*b*/24*c*, 24*d*/24*e*, 24*f* are configured as a differential signal pair and the wafer 25 is a ground wafer. The signal wafers 24 are intended to carry multiple signal signals, and particularly, pairs of differential signals. The ground wafers 25 are intended to be connected to one or more ground planes on the PCB and its terminals will carry ground signals as opposed to differential signals. Therefore the plurality of wafers carries signals in a pattern "ground, signal+, signal−, ground". Said terminals 21 embedded in the wafers are identical except for their relative size, for brevity. The ground wafer 25 is higher than the signal wafers 24.

Each wafer 24/25 is embedded with four said terminals 21 aligned with each other in a vertical plane thereof. The upper two terminals are configure as an upper pair 215 of the terminals which are mirrored images of each other, all of the contacting portions 211 slant toward each other so that the upper pairs 215 of the terminals are co-linear along a longitudinal of the mating slots 111 and received in the passageways 112 of the upper mating slots. The lower two terminals are configure as a lower pair 216 of the terminals which are mirrored images of each other, all of the contacting portions 211 face toward each other so that the lower pairs of the terminals are aligned in a line and received in the passageways 112 of the lower mating slots 111. The terminals in a same row are aligned along a transverse or horizontal line, not long the contacting portions but also the body portions and tail portions. One terminal of one of the pair of differential signal terminal wafers and one terminal of the other one of the pair of differential signal terminal wafers cooperate to carry an equal but opposite polarity signal and so the same to other three terminal. Each of the terminals of each ground wafer carry ground signal between each pair of differential terminal. The insulating support 23 defines two supporting potions 231 extending forwards from a front edge thereof, which are disposed between the two contacting portion 211 of the upper pair and lower pair respectively to enhance the stability of the contacting portions.

Figure 10:
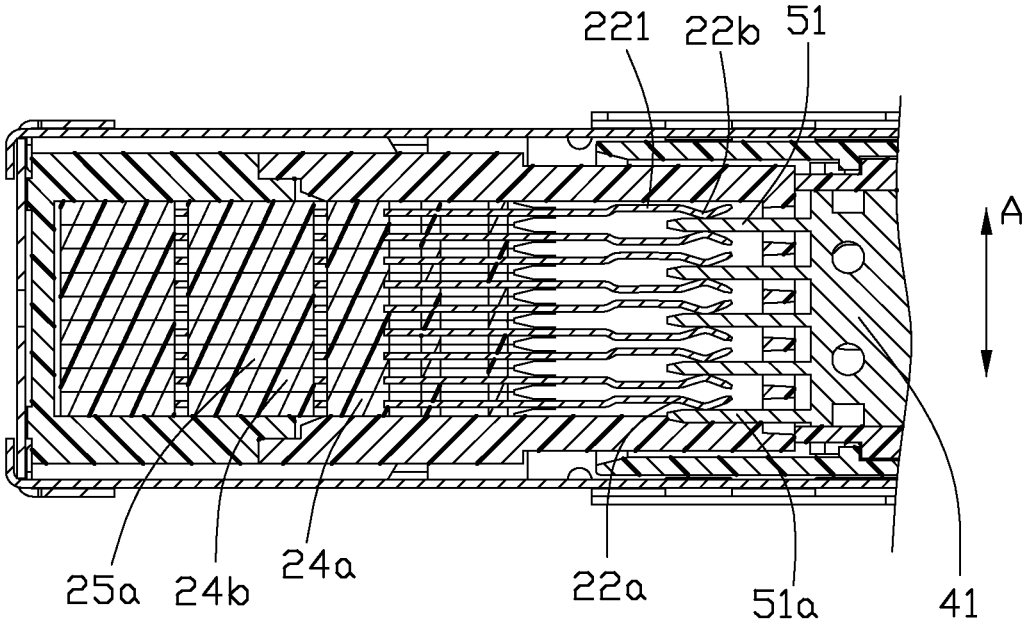
FIG. 10 is a cross-section view of the electrical connector assembly taken along lines 10-10 shown in FIG. 1.

Each wafer 24/26 further is embedded with a ground contact 22 between the lower pair and the lower pair of the terminals 21. The ground contact 22 includes a contacting portion 221, a tail portion 222 and body portion (not labeled) connecting with the contacting portion 221 and the tail portion 222. The contacting portion 221 slant toward one adjacent contacting portion 221 of the grounding contact of the adjacent terminal wafer, such as terminal wafers 24*b*, 25*a*, so that as best shown in FIG. 10, the two contacting portions 221 are configured as one mating pair 226 thereby forming a mating channel to accommodate a corresponding contacting pin 51 of the plug connector 102. Two adjacent contacting portions 221 have a transverse mating direction A which is perpendicular to a vertical mating direction B of the pairs of terminals of the wafer. In the vertical mating direction, the contacting portions of the ground contacts are engaged with the plug connector 103 no later than the contacting portions of the terminals to arrive a good engagement of said two connectors, in this preferred embodiment, the contacting portions 211 of the terminals and the contacting arm 221 of the ground contact are co-linear in the vertical mating direction B. The ground contact 22*a* of the terminal wafer 24*a* or one outmost terminal wafer slants outwards to contact with corresponding contacting pin 51*a*. The contacting portions 221 of the ground contact 22 bend to offset along the transverse direction firstly and then reversely bend to remedy said offset, so that two adjacent contacting portions 221 have elasticity to engage with contacting pin.

The plug connector 101 further includes a ground plate 50, which has a plurality of contacting pins 51 extending forward from the base 52 and parallel to the card edges 41. The grounding plate 50 is retained in an insulating base 53 and then assembled in the plug connector. The base defines two recesses 521 at two transverse sides and two holes 522 between the transverse sides to fitly retain in the insulting base. The contacting pins 51 are arranged in one row parallel to and between the card edges 41. The contacting pins 51 are inserted in the corresponding mating pair 226 of the ground contacts to achieve an engagement. Combination with FIG. 3, the receptacle connector 101 defines a row of opening 114 running through the front face 112, the mating pairs 226 of the grounding contacts 22 are aligned with corresponding openings 114 so as to receive the corresponding contacting pins 51 of the plug connector. The body portions and the tail portion of the ground pin are similar to that of the terminals so that all of them are parallel to each other. The ground contacts 22 and the ground plate 50 benefit cross talk between the upper pairs and lower pairs of the terminal.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

I claim:

1. An electrical connector assembly, comprising: a receptacle connector comprising: a connector housing defining two parallel mating slots vertically spaced from each other; and a plurality of terminal wafers juxtaposedly loaded in the connector housing, each terminal wafer comprising an upper pair of contacting portions and a lower pair of contacting portions, both of the upper and lower pairs of contact portions accessible from the mating slots, respectively; each of said terminal wafers further defining a ground contact with a contacting portion disposed between the upper pair and lower pair of the contacting portions; the plurality of terminal wafers comprising pairs of differential signal wafers and ground wafers which are arranged in an alternating sequence in the connecting housing; and a plug connector intended to mate with the receptacle connector, the plug connector comprising two card edges intended to be inserted in the mating slots respectively and a ground plate with a row of contacting pin vertically spaced between said two card edges; the contacting pins of the ground plate touch with pairs of ground contacts formed with two adjacent ground contacts in two adjacent terminal wafers, wherein the contacting portions of said two adjacent ground contact slant towards each other so as to construct a mating pair of the ground contacts to clamp the contacting pins of the ground plate.

2. The electrical connector assembly as claimed in claim 1, wherein the connector housing defines a row of opening between said two mating slots to be inserted with the contacting pin of the ground plate, the mating pairs of the ground contacts are aligned with the corresponding opening.

3. The electrical connector assembly as claimed in claim 2, wherein the mating pair is cooperated by one ground contacts of one of differential signal pair and one ground contacts of the ground wafer.

4. An electrical connector assembly comprising: a connector housing defining a front face and two vertical stacked mating slots; and a plurality of terminal wafers arranged alongside with each other in the connector housing, each terminal wafer comprising an upper pair of terminals and a lower pair of terminals in a same vertical plane thereof, the upper pairs and the lower pairs of the terminals of the plurality of terminal wafer comprising contacting portions exposing to the mating slots respectively which have a vertical mating direction; wherein each terminal wafer further comprises a ground contact between said upper pair and lower pair of the terminals in the vertical plane, the ground contact comprising a contacting portion which has a transverse mating direction perpendicular to the vertical mating direction, wherein the plurality of terminal wafers comprise ground wafers and pairs of different signal wafers arranged in an alternate sequence with the ground wafer, wherein one of said two adjacent ground contact is located in one ground wafer, wherein the contacting portions of the terminals and the contacting portion of the ground contact are co-linear in the vertical mating direction.

5. The electrical connector assembly as claimed in claim 4, wherein in the vertical mating direction, the contacting portions of the ground contacts are engaged with a plug connector no later than the contacting portions of the terminals.

6. The electrical connector assembly as claimed in claim 4, wherein the contacting portions of two adjacent ground contacts bend slantwise towards each other to define a mating channel.

7. The electrical connector assembly as claimed in claim 6, wherein one of said two adjacent ground contact is located in one ground wafer.

8. The electrical connector assembly as claimed in claim 4, wherein the pair of ground contacts of the adjacent two terminal wafers are configured to be deflectable opposite to each other in the transverse mating direction and commonly define a gap therebetween in the transverse direction for receiving a grounding pin of a complementary connector.

9. The electrical connector assembly as claimed 8, wherein the housing defines a plurality of openings in a front face, and the plug connector includes a grounding plate with thereof a plurality of grounding pins extending into the corresponding openings, respectively, for mating with the corresponding pairs of ground contact.

10. The electrical connector assembly as claimed in claim 9, wherein said grounding plate extends in a plane defined by the transverse mating direction and a front-to-back mating direction perpendicular to both said vertical mating direction and said transverse mating direction.

11. An electrical connector assembly comprising: a first connector defining a first insulative housing having a front mating slot portion and a rear wafer receiving portion in a front-to-back direction, a slot defined in the front mating slot extending along a transverse direction perpendicular to the front-to-back direction and communicating with an exterior in the front-to-back direction; and a plurality of wafers stacked upon one another in the transverse direction, each of said wafer extending in a vertical plane defined by the front-to-back direction and a vertical direction perpendicular to both said front-to-back direction and said transverse direction, each of said wafers including a pair of differential pair contacts and a grounding contact spaced from each other while both being embedded within an insulator via an insert molding process; wherein the insulator defining a forward protrusion extends into the front mating slot portion so as to cooperate with an inner face of the front mating slot portion to sandwich the pair of differential pair contacts therebetween, wherein the front mating slot portion defines a plurality of passageways to receive contacting sections of the corresponding differential pair contacts, wherein the contacting sections of the differential pair contacts are deflectable in the vertical plane while grounding section of the grounding contacts are deflectable in the transverse direction perpendicular to said vertical plane.

12. The electrical connector assembly as claimed in claim 11, wherein either the inner face of the front mating slot portion or the contacting section of differential pair contacts defines an embossment to abut against the other so as to enhance mating between the contacting sections and a mating tongue of a second connector which is received in the slot of the front mating slot portion.

13. The electrical connector assembly as claimed in claim 11, further including a second connector mateable with the first connector, wherein said second connector defines a mating tongue received in the slot for mating with the pairs of differential pair contacts, and said second connector further includes a ground plate spaced from the mating tongue and defining a plurality of grounding pins mechanically and electrically connected to the corresponding grounding contacts, respectively.

14. The electrical connector assembly as claimed in claim 13, wherein a front face of the front mating slot portion defines a plurality of openings through which the grounding pins extend, respectively, to mechanically and electrically connect to the corresponding grounding contacts, respectively.

* * * * *